United States Patent [19]

Chase et al.

[11] Patent Number: 4,613,996

[45] Date of Patent: Sep. 30, 1986

[54] FOLDING CHILD SUPPORT

[76] Inventors: Al L. Chase; Ursula H. Chase, both of Box 170, Freedom, Me. 04941

[21] Appl. No.: 624,617

[22] Filed: Jun. 26, 1984

[51] Int. Cl.[4] ..... A47C 17/52

[52] U.S. Cl. ..... 5/2 R; 5/135; 5/136

[58] Field of Search ..... 16/266, 363, 374; 297/DIG. 6, 468; 312/313, 39, 40, 10; 5/2 R, 95, 133, 136, 159, 135, 162

[56] References Cited

U.S. PATENT DOCUMENTS

| | | | |
|---|---|---|---|
| 119,312 | 9/1871 | Burr | 5/2 R |
| 242,961 | 6/1881 | Nelson | 5/133 |
| 1,658,291 | 2/1928 | Kautz | 16/374 |
| 1,736,653 | 11/1929 | Keichline | 5/133 |
| 2,199,102 | 4/1940 | Hough | 16/374 |
| 2,203,538 | 6/1940 | Meilink | 108/48 |
| 3,088,127 | 5/1963 | Eames | 5/136 |
| 3,656,193 | 4/1972 | Schneider et al. | 5/308 |
| 3,741,403 | 6/1973 | Fleischer, Jr. et al. | 312/40 |
| 4,004,583 | 1/1977 | Johnson | 297/468 |
| 4,098,469 | 7/1978 | McCarthy | 312/39 |
| 4,440,458 | 4/1984 | Berkman | 312/10 |

FOREIGN PATENT DOCUMENTS

| | | | |
|---|---|---|---|
| 93173 | 8/1897 | Fed. Rep. of Germany | 16/374 |
| 148512 | 1/1955 | Sweden | 5/136 |

*Primary Examiner*—William E. Lyddane
*Assistant Examiner*—Joseph Falk
*Attorney, Agent, or Firm*—Daniel H. Kane, Jr.

[57] ABSTRACT

A folding child support (10) for diaper changing and infant dressing includes an elongate housing (12) having a back (14) and side portions (15) for mounting on a wall or other vertical surface with hinge projections (16) projecting from the side portions (15) near the bottom of the housing (12). An elongate base (20) provides a recessed child support surface (40) with safety boundary panels (42, 44) and is constructed for complementary engagement in the elongate housing (12). The base (20) is provided with complementary hinge projection receivers or bearing surfaces (62) for removable and replaceable interfitting hinged coupling of the base (20) with the hinge projections (16) of the housing (12) and for pivotal folding of the base (20) relative to the housing (12) between a closed position and a substantially horizontal open position. The housing (12) and base (20) are formed with complementary interfitting stop edges (30, 70) for abutting interlocking engagement of the base (20) in the substantially horizontal open position. The housing (12) and base (20) include a variety of integrally molded utility features.

29 Claims, 18 Drawing Figures

FOLDING CHILD SUPPORT

TECHNICAL FIELD

This invention relates to an improved folding child support suitable for mounting on a wall or other vertical surface in order to provide a folding base or bed for supporting a child, for example, during diaper changing. The invention also provides a new hinged coupling between a housing and base or other relatively pivoting or folding parts.

BACKGROUND ART

A recurrring problem for parents and custodians of small infants in public places is the unavailability of suitable sanitary supporting surfaces or tables at a semi-private location such as a restroom for diaper changing. A variety of baby handling devices and dressing tables have been developed including free standing convertible furniture pieces, and tables and boards for mounting on bathtubs and cribs. None of these devices, however, is adapted for use in semipublic places and are intended for use in the home. For example, U.S. Pat. No. 3,656,193 describes a portable dressing tray for babies which is placed for use on a surface such as a bed, table, commode, etc. The tray is not suitable for a public facility, cannot be folded into a mounted housing for storage, and must be transported by the user.

The Meilink U.S. Pat. No. 2,203,538 discloses a folding baby dressing table secured to a wall or door so that when out of use it may be positioned substantially flush against the surface of the wall or door. The changing surface is a fabric bed stretched on a "U" shaped frame pivotally mounted to the wall or door. The Meilink device suffers a number of disadvantages. The supporting surface does not provide a recessed base or other arrangement for restraining a child on the changing surface. There is no readily available method for providing a sanitary surface other than the awkward solution of changing the fabric bed itself stretched on the "U" shaped frame. The floor engaging strut does not provide a stable base and support for a moving child, not are there readily available shelves and receptacles for accessories. The suspended or hanging pockets are not readily available or visible to the parent or custodian who is dressing an infant on the support. Finally, the frame fabric bed cannot be folded into a housing enclosure for storage.

OBJECTS OF THE INVENTION

It is therefore an object of the present invention to provide a child supporting unit suitable for installation on walls or other vertical surfaces which may be folded into a housing against the wall or other surface in storage position and which provides a strong and stable base in the open position for dressing infant children.

Another object of the invention is to provide a new hinge coupling or pivoting and folding coupling between a recessed base, for example, for supporting and securing a child, and a vertically mounted housing for convenient opening and closing and for removal of the base for cleaning.

Other objects of the invention include providing a child supporting unit in a unitary molded plastic structure which is durable and adapted for semipublic use and readily cleaned; which is provided with a readily renewable sanitary surface cover for sequential users; and which includes readily accessible shelves and receptacles for accessories and conveniences associated with dressing infant children.

DISCLOSURE OF THE INVENTION

In order to accomplish these results, the present invention provides an elongate housing comprising a back and side portions constructed and arranged for mounting on a wall or other vertical surface and an elongate base which provides the child support surface with safety boundary portions. The base is constructed and arranged for complementary engagement in the elongate housing in a closed position. The housing and base are formed respectively with complementary pivoting or folding couplings which in the preferred embodiment comprise curved hinge projections and hinge projection receivers for removable and replaceable interfitting hinged coupling of the elongate base at the bottom of the housing. The base therefore pivotally folds relative to the housing between the closed position and a substantially horizontal open position.

According to the invention, the internal structure of the housing itself provides the bracing support for the base in the open position. In the preferred embodiment, the housing is formed with a first stop edge at the back of the housing while the base comprises a complementary second stop edge for abutting against the first stop edge for securing and maintaining the base substantially horizontally in the open position. The base stop edge and the housing stop edge are formed with complementary interlocking or interengaging surfaces for interlocking abutment thereby securing the child support surface in a safe horizontal position. Furthermore, the hinge projections are generally cylindrical projections from the sides of the housing while the receivers comprise curved bearing surfaces formed in the boundary portions of the base for smooth rotational pivotal motion of the base relative to the housing during folding between the closed and open positions.

A feature and advantage of the hinged coupling for pivotal folding engagement between the housing and base according to the present invention is that the base is self supporting within the housing in the substantially horizontal open position. That is, the integral structures of the housing and base provide bracing surfaces for bracing engagement and support of the base in the open position. Furthermore, this is accomplished without addition of moving parts such as lines or linkages between the housing and base and without further contact with the ground or wall as would be required with folding struts or legs.

According to another aspect of the invention, the curved bearing surfaces may be formed with the curved arms extending from the hinge coupling end of the base. The curved arms terminate in the base stop edge. The complementary housing stop edge is formed with extending guide surfaces defining guide channels for guiding the curved arms at the end of the base and maintaining the complementary curved hinge bearing surfaces in close fitting proximity but permitting retraction of the curved arms through the guide channels for removing and replacing the base with respect to the housing.

A feature and advantage of the invention is that the elongate base comprises a unitary molded plastic unit with a recessed child support surface and boundary panels on each side of the base rising above the child support surface. The upper head of the boundary panels and the boundary panels are formed with molded depressions and receptacles for accessories and a child securing and restraining strap.

The elongate housing also comprises an integrally molded unit with shelves for accessories and a towel roll shelf with sufficient curvature and a dispensing slot for ready dispensing of towel segments along the child support surface to renew the sanitary cover.

The integrally molded housing and base component units of the folding child support are readily folded, according to the invention, between the respective closed and open position with complementary engaging notch and rib portions for securing the folding child support in closed position. In the open portion the complementary interfitting stop edges assure the stability and secure retention of the base in the horizontal working position. Moreover, the hinged coupling according to the invention provides ready folding of the base between the opened and closed positions and in cooperation with the stop edges and guide channels provides for servicing by retraction and replacement of the base when necessary.

Other objects, features, and advantages of the invention will become apparent in the following specification and accompanying drawings.

BRIEF DESCRIPTION OF THE DRAWINGS

FIG. 3 is diagrammatic plan view of the upright housing while

FIG. 6 is a plan view of the elongate base while

FIGS. 6C and 6D are fragmentary views simplified by cutting off the far side of the base so that the far side boundary panel is not shown.

FIG. 12A is a cross sectional view looking down through the housing at the hinge projections, housing stop edge and guide channels, while

DESCRIPTION OF PREFERRED EXAMPLE EMBODIMENTS AND BEST MODE OF THE INVENTION

Figure 1:
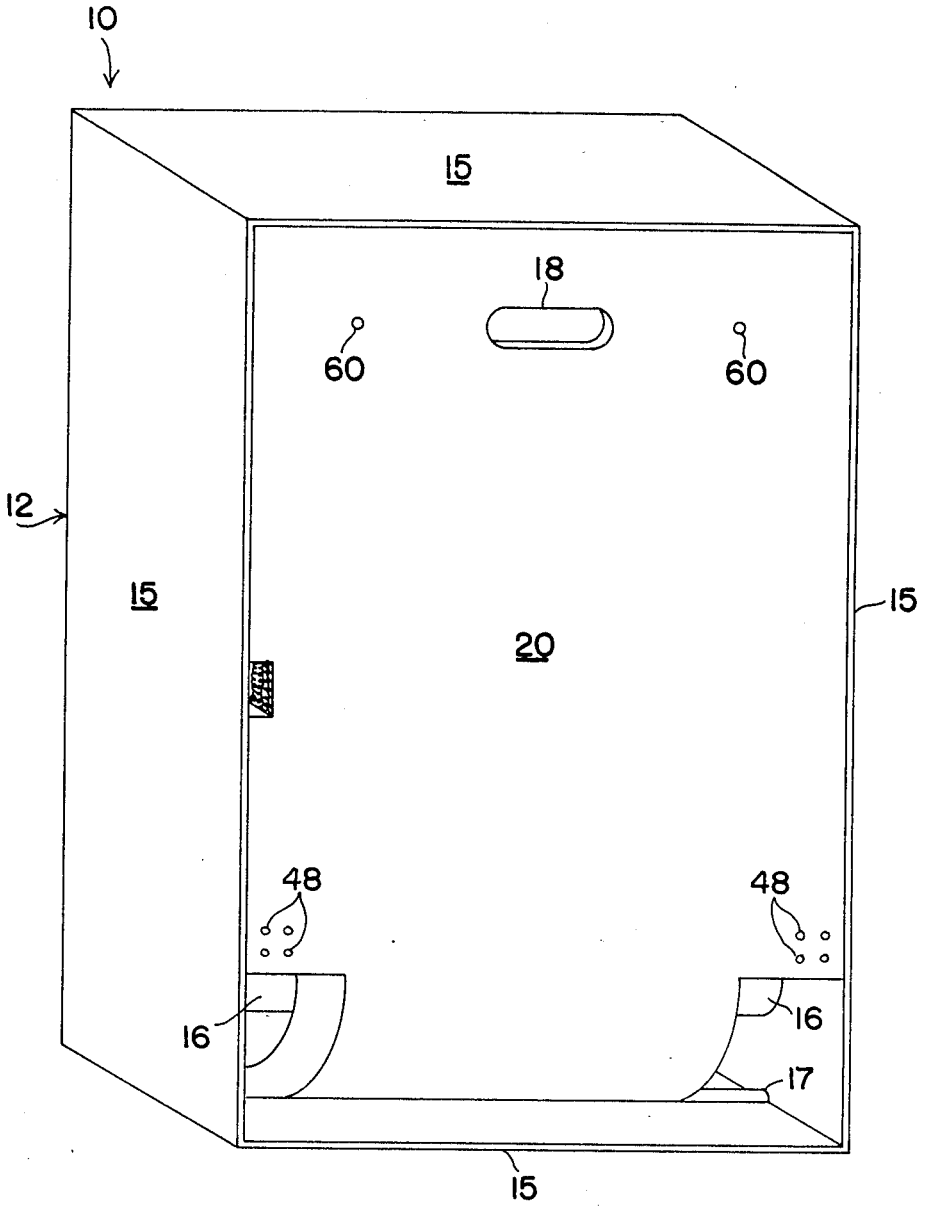
FIG. 1 is a diagrammatic perspective view of the vertically mounted folding child support unit with the base secured in closed position relative to the housing.

The folding child support unit 10 illustrated in FIG. 1 includes an elongate housing or framework 12 formed with a backing 4 and side portions or wall protions 15 for mounting on a wall or other vertical surface. The housing 12 is also formed with hinge projections 16 projecting from the side portions 15 near the bottom of the housing 12. An elongate base 20 providing the child support surface 40 is constructed and arranged as hereafter described for complementary engagement in the elongate housing 12 in a closed position as shown in FIG. 1. The base 20 is formed with complementary hinge projection receivers, not visible in FIG. 1, for hinged coupling with the hinge projections 16 at the bottom of housing 15 so that the base 20 may be pivotally folded relative to the housing 12 between the closed position and a substantially horizontal open position using the handle 18. In the closed position a retaining groove 72 in the bottom of the base 20 not shown in FIG. 1 but visible in FIGS. 6A–6E engages the retaining rib 17 formed across the bottom wall of the housing 12 to secure the closed position.

While the folding child support unit 10 is shown in FIG. 1 with the elongate axis oriented in the vertical direction, it may of course also be constructed and arranged with the elongate axis in the horizontal direction. According to this configuration the hinge projections 16 extend from the shorter sides 15 of the housing 12 at the bottom of the horizontally oriented unit and the base 20, of course, opens from the elongate side down. For this horizontal axis embodiment of the folding child support unit 10 some reorientation of the internal structure of the housing 12 is required as subsequently described.

Figure 2:
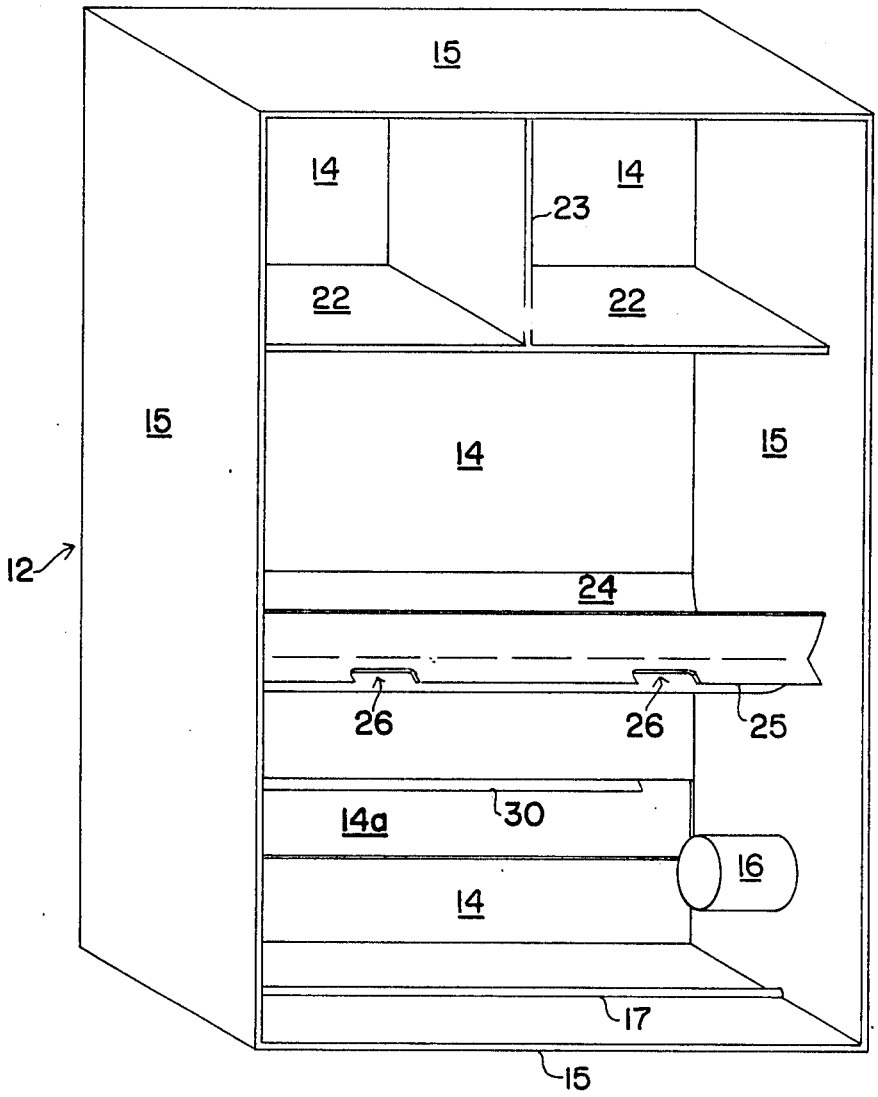
FIG. 2 is diagrammatic perspective view of the elongate housing mounted on a wall or other vertical support showing the shelves for holding accessories and molded functional projections, etc.
Figure 3:
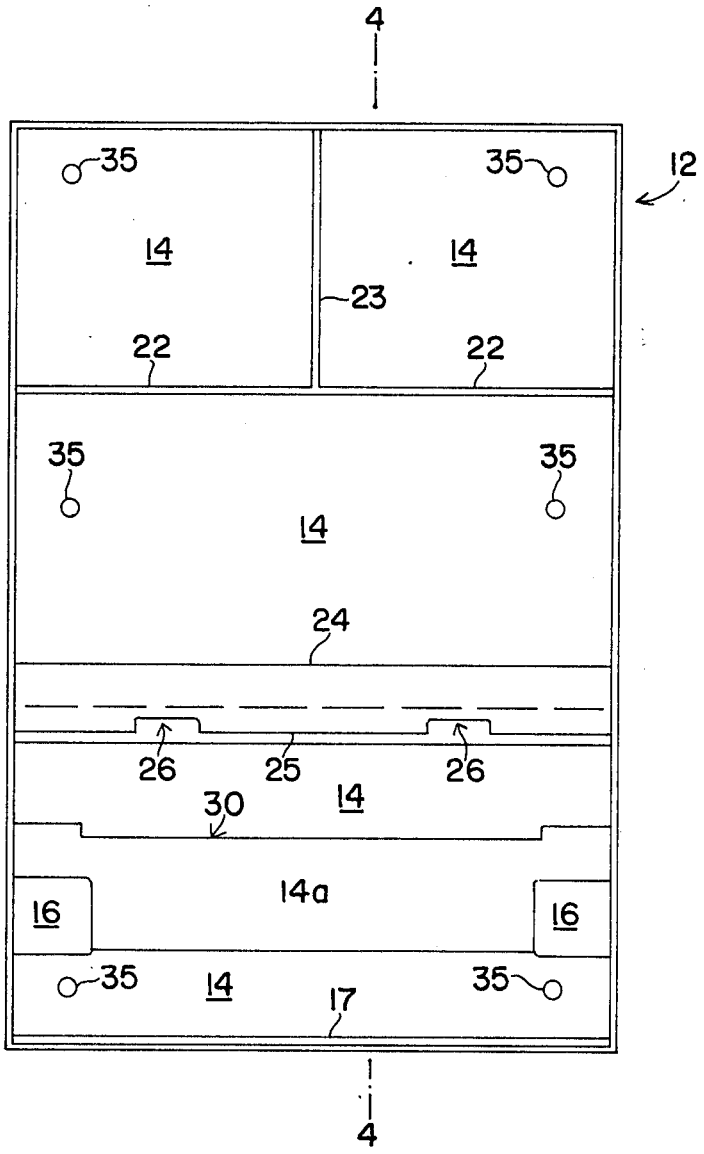
Figure 4:
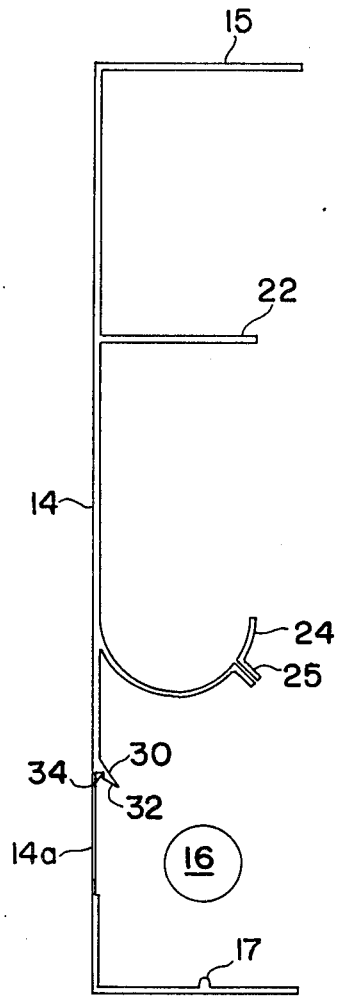
FIG. 4 is a side cross section in the direction of the arrows on lines 4—4 of FIG. 3.

Referring to the embodiment of FIG. 1, the base 20 may be entirely removed and replaced relative to the housing 12 and the separate housing 12 is shown in greater detail in FIGS. 2, 3 and 4. Within the outer walls or sides 15 the housing 12 incorporates a set of upper shelves 22 and divider 23 for stacking diapers or other objects. Mechanical diaper dispensers may be housed in the upper shelves 22. Below the storage shelves 22 is formed a curved shelf 24 for supporting and retaining a towel roll. The curved shelf 24 includes the guide slot 25 for unrolling and dispensing towel segments from the towel roll. The guide slot 25 is formed with finger cutouts 26 for grasping the end of a towel roll passing through the slot 25 and also serves as a cutting edge for the paper towels. A feature and advantage of the vertical axis configuration and mounting of the folding child support unit 10 is that the towel may be dispensed through the slot 25 directly along and on the elongate child support base 20, as hereafter described.

Moving down the housing 12, the next structure encountered is the housing stop edge 30 which projects inwardly across the major part of the width of the housing 12 from the back 14. The stop edge 30 may extend all the way across the back 14 or part way across the back 14. The projecting stop edge 30 includes a sloping or inclined and downwardly facing guide surface 32 leading into the notch or groove 34 in which is received the base stop edge 70, not shown in FIGS. 2–4 but visible in FIGS. 5 and 6 as hereafter described. Adjacent to the notch 34 and in the space below the housing stop edge 30, the back 14 includes in this example a thin walled section 14*a* which in cooperation with the housing stop edge 30 defines the notch 34. The section 14*a* may be formed with the same thickness as back 14 in which case the projecting stop edge 30 is displaced further over from the back to provide the notch with adequate spacing.

The hinge projections 16 are clearly visible in FIGS. 2, 3, and 4 as cylindrical hinge projections 16 projecting from the sides or walls 15 at the bottom of the housing 12. The function of the cylindrical hinge projections 16 in the hinge coupling is hereafter described with the reference to the base 20. Across the bottom wall or side 15 of the housing 12 is also shown the retaining ridge or rib 17 which cooperates with the base 20, as hereafter described, to engage and retain the base 20 in closed position within the housing 12. The back 14 of the housing 12 is formed with 4 to 6 holes 35 for securing the housing 12 to a wall, door, or other vertical surface, structure, or support.

The housing 12 is preferably formed as a unitary piece of molded plastic for durability under semipublic use and ease in cleaning. For typical dimensions, the housing 12 may be approximately 3 feet (1m) along the vertical or elongate axis and 2 feet (61 cm) wide with a depth of the sides or walls 15 of approximately, for example, 8 inches (20 cm). The shelves 22 and 24 are recessed within the housing 12 and may have a depth of, for example, 6 inches (15 cm). Overall, the housing 12 may have a shape and appearance departing from rectangular, for example, with a slight inward taper from the bottom to the top so that it is slightly trapezoidal in order to provide a pleasing appearance. The corners may also be rounded to a desired degree. Thus, the exact outline shape of the elongate housing 12 and base 20 are not critical.

A number of additional components may be associated with or installed in the housing 12. For example, an ultraviolet sanitizing lamp may be installed in the housing 12, a waste receptacle may be appended from the housing 12, and diaper dispensers may be installed in the shelves 22.

Figure 5:
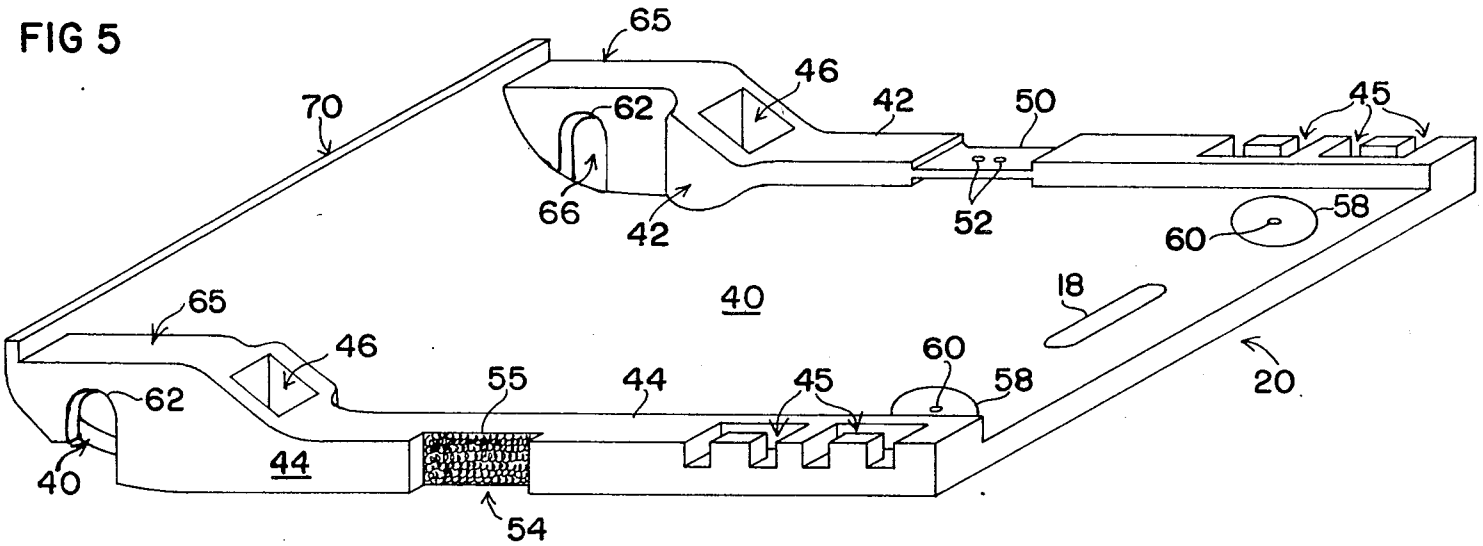
FIG. 5 is a diagrammatic perspective view of the elongate base in substantially horizontal open position showing the child support surface, etc.
Figure 6:
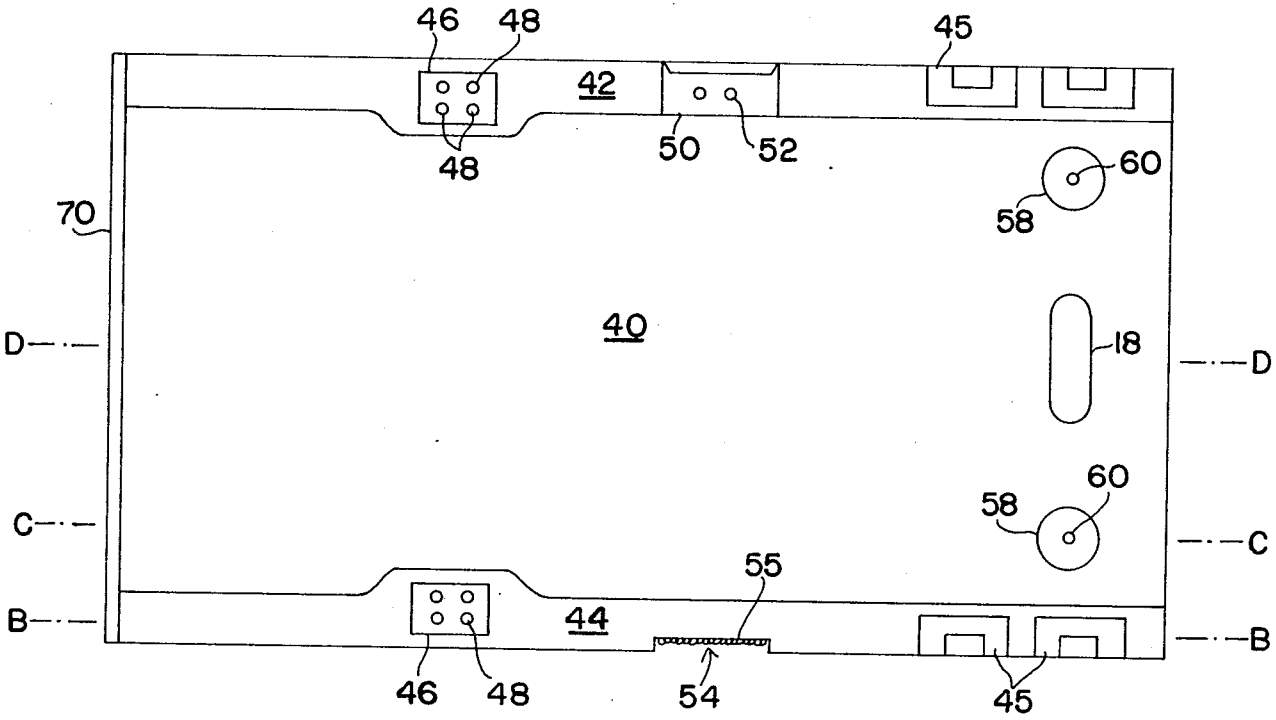
Figure 6A:
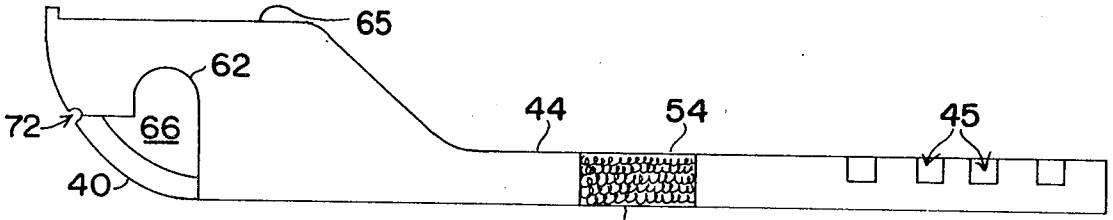
FIG. 6A is a side view from the left side of the base.
Figure 6B:
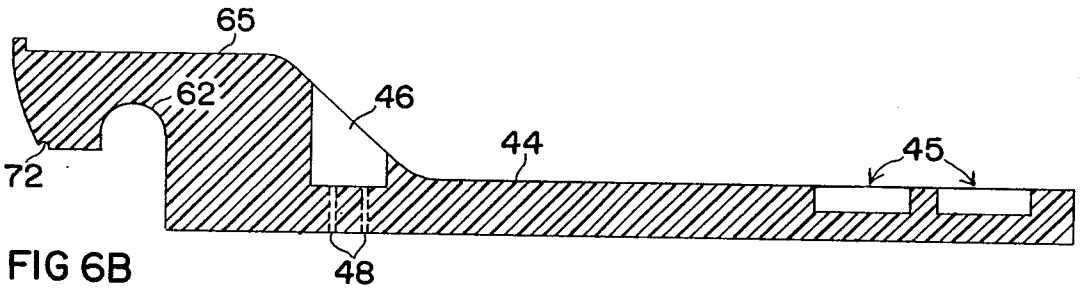
FIGS. 6B, 6C, and 6D are side cross sections through the base in the direction of the arrows on lines B—B, C—C, and D—D respectively of FIG. 6.
Figure 6C:
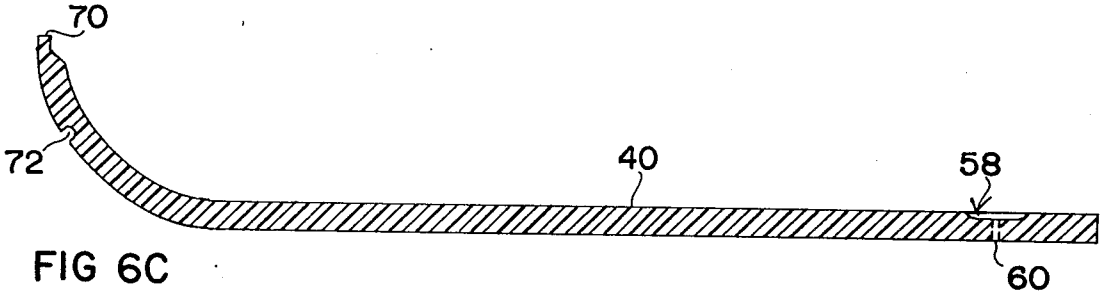
Figure 6D:
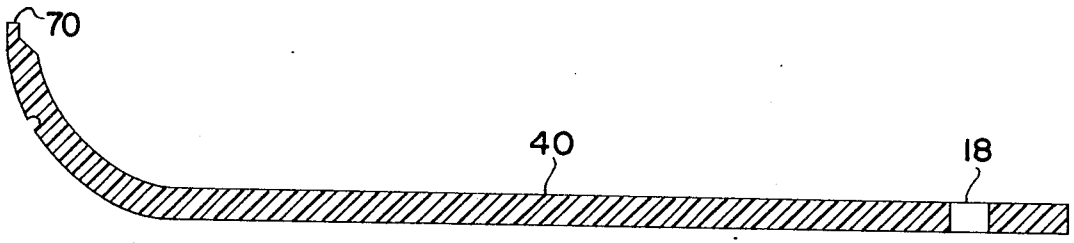
Figure 6E:
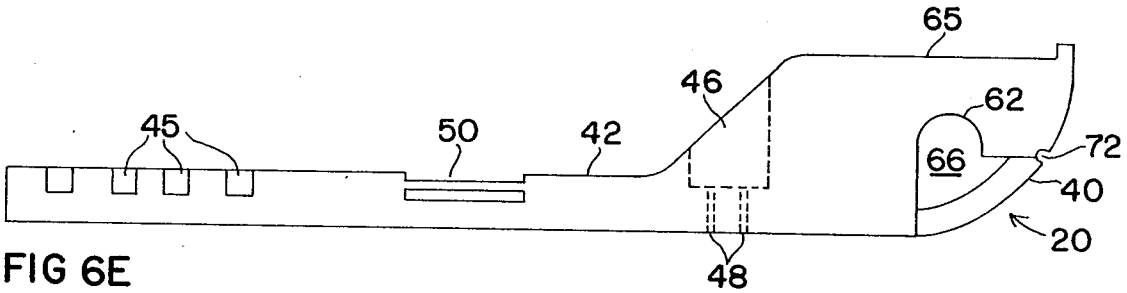
FIG. 6E is a side view of the elongate base from the right side of the base.

The elongate child support base 20 which is pivotally coupled at the bottom of the housing 12 and from which it is removable and replaceable, is shown separately in further detail in FIGS. 5 and 6. The features of the base 20 hereafter described are also clarified in the side views and cross sectional views of FIGS. 6A–6E. The elongate base 20 is formed with a recessed child support surface 40 with safety boundary portions, edges, or panels 42 and 44. The boundary panels 42 and 44 are formed with "U" shaped depressions 45 on either side with the legs of the "U" shaped depressions 45 extending to the outsides of the boundary panels 42 and 44 thereby providing convenient and effective hooks for hanging bags or other objects from the base 20 when it is open in the horizontal position. The upper head of the boundary panels 42 and 44 are also formed with one or more molded wells or receptacles 46 for holding bottles, cans and similar objects. The wells or recptacles 46 may be formed in the upper part of the boundary channels 42 and 44 with a vertical axis when the base 20 is in the horizontal position or at an angle, for example, with the axis of the well 46 at a 45° angle with the horizontal plane when the base 20 is in the open horizontal position. The base of each well or receptacle 46 is formed with drain holes 48 which are also visible through the back of the base 20 in the illustration of FIG. 1.

The boundary panel 42 on the right hand of side of the base 20 is formed with a bridge 50 with holes 52 for securing the end of a safety strap, not shown, around the bridge 50, for example, by rivets, grommets, or metal tabs passing twice through the end of the strap on either side of the bridge 50 through the holes 52. The free end of the safety strap can then be passed over an infant positioned on the child support surface 40 for securing the child in safe position and preventing the child from falling off the child support surface 40 during a moment of inattention. The free end of the safety strap is then secured to an indentation or depression 54 formed in the boundary panel 44 on the left side of the base 20. the depression 54 can be provided with an adhesion surface 55 such as Velcro (trademark) type loops while the free end of the safety strap may be formed with a complementary adhesion surface such as Velcro (trademark) type hooks. The child support surface 40 of base 20 is also formed with shallow dishes or depressions 58 useful, for example, for retaining safety pins or other small objects. The molded shallow dishes 58 are formed on either side of the handle 18 in the example of FIGS. 5 and 6 and are also formed with drain holes 60 through the base 20 visible from the bottom of the base 20 as shown in FIG. 1.

At the pivotal or hinged coupling end of the base 20 the boundary panels 42 and 44 are formed with curved bearing surfaces 62 amounting to hinge projection receivers for receiving and bearing against the cylindrical hinge projections 16 projecting from the lower sides 15 of the housing 12. It is noted that the boundary panels 42 and 44 in this example curve upward effectively providing raised arms 65 rising above the support surface 40 with the curve bearing surfaces 62 formed on the lower surfaces of the arms 65. The curved bearing surfaces 62 are formed with a radius of curvature for complementary engagement with the cylindrical hinge projections 16 and for smooth rotational pivotal motion of the base 20 relative to the housing 12 during folding of the base 20 between the closed and open positions.

While the cylindrical hinge projections 16 have been illustrated and described in this example as truncated projections, it is apparent that the portions 16 may alternatively extend all the way across the housing, for example, as one cylindrical bar. Thus, the phrase "hinge projections" and "hinge projection means" as used herein and in the claims is intended to encompass this element of the hinge whether truncated or extending across the housing. Similarly the bearing surface here illustrated with reference to the bearing surfaces 62 in the arms 65 of boundary panels 42 and 44 may also extend across the base to include the end of the child support surface 40 if desired. Furthermore, when using the truncated hinge projections such as the cylindrical projections 16, the hinge projections and hinge couplings can be arranged to extend on the outside of the housing rather than the inside.

In the example of FIGS. 5 and 6A–6E, the child support surface 40 curves upward to meet the raised arms 65 of boundary panels 42 and 44 and clear openings 66 between the bed or child support surface 40 and the boundary panels 42 and 44 can be seen at the location of the bearing surfaces 62. At the top of the upwardly curved bed 40 where it joins the raised arms 65 and at the hinged coupling end of the base 20 is formed the base stop edge 70 constructed and arranged for complementary engagement and abutment against the housing stop edge 30 previously described. Thus, stop edge 70 may extend all the way across the base 20 or part way across to match the housing stop edge 30. In the embodiment of the present invention illustrated in FIGS. 1–6, the base stop edge 70 abuts the housing stop edge 30 with an interfitting or interlocking engagement in which the base stop edge 70 sliding along the inclined guide surface 32 lodges into the groove or inset 34 defined by the housing stop edge 30. A feature and advantage of this arrangement is that the base 20 when open to the horizontal position is retained in a secure interlocking or interfitting engagement with the housing 12 so that the base 20 cannot be dislodged by motion of an infant on the child support bed or surface 40 of the base 20.

Another feature of the base 20 appearing in the cross sectional views of FIGS. 6A–6E is the retaining groove 72 formed across at least a portion of the bottom of the base 20 at the hinged coupling end for complementary engagement with the retaining rib or ridge 17 formed across the bottom side 15 of the housing 12 as shown in FIG. 2. In the closed position or vertical position, the retaining groove 72 engages the retaining rib 17 for retaining and securing the base 20 in closed position within the housing 12.

The hinged coupling end of the base 20 can be formed with a counter balance weight on the housing side of the hinge projections 16 and receivers 62 to bias the base 20 toward closed position when a child is removed from the base 20. In the unitary molded plastic base 20, the end of the base 20 at the housing side can be formed with a hollow closed receptacle of sand or other counter weight material to swing the base 20 toward closed position. This feature can also be incorporated in the embodiment of FIGS. 8–11 at the end beyond receivers 92, hereafter described.

Figure 7A:
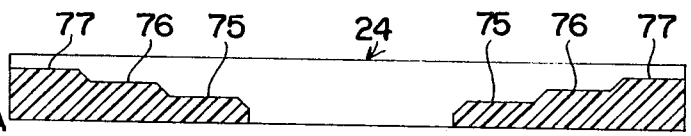
FIG. 7A is a side cross section through the towel roll shelf in the direction of the arrows on lines A—A of FIG. 7.
Figure 7:
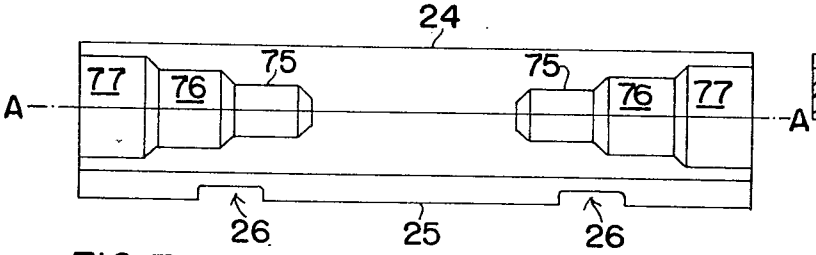
FIG. 7 is detailed fragmentary plan view of the towel roll supporting and dispensing shelf of the elongate housing.

An alternative configuration for the towel roll holding curved shelf 24 is shown in the fragmentary views of FIGS. 7 and 7A. According to this embodiment the curved shelf 24 is formed with complementary pairs of steps 75, 76, 77 with progressively greater height and greater spacing on either side of center and lying in the curve of the shelf 24 for accommodating and holding towel rolls of different length. A towel roll placed on the shelf 24 settles between the pair of steps 75, 76, or 77 appropriate to its length so that the towel roll does not slide back and forth in the shelf 24.

The elongate child support base 20 is preferably formed as an integrally molded piece of plastic with all the features described with reference to FIGS. 5 and 6 integrally molded into the base 20. The dimensions are selected for complementary engagement and fitting into the housing 12 when the base 20 is in closed vertical position. Thus, the base 20 may be tapered or provided with rounded corners in a manner complementary with the shape and appearance selected for the housing 12. Furthermore, as heretofore described, the base 20 and housing 12 may be constructed and arranged with the elongate axis oriented in the horizontal position and with the hinged coupling adjacent the lower elongate side 15 of the housing 12. In that event, the integrally molded features and structures of the housing 12 and base 20 are appropriately rearranged for pivotal coupling along the elongate axis.

An alternative preferred example embodiment for the hinged coupling between the housing 12 and base 20 is illustrated in FIGS. 8–11. In this example, the housing 12 is formed in the manner heretofore described with the cylindrical hinge projections 16 and retaining rib 17 but with a housing stop edge 80 of different configuration. Referring at the same time to FIGS. 12A and 12B, the housing stop edge 80 is in two separate parts on either side of the housing 12 and each part extends integrally from the back 14 and side 15 of the housing 12 as shown in FIG. 12A. Referring again to FIGS. 8–11, the housing stop edge 80 is formed on its lower side or surface with a projecting edge or snout 82 for complementary abutment against and interlocking engagement with the base stop edge, as hereafter described. Furthermore, the housing stop edge 80 is formed with an extended and in this instance curved guide surface 84 spaced from the cylindrical hinge projection 16 for defining a guide channel 85 on either side of the housing 12 between the respective guide surface 84 and cylindrical hinge projection 16.

Figure 8:
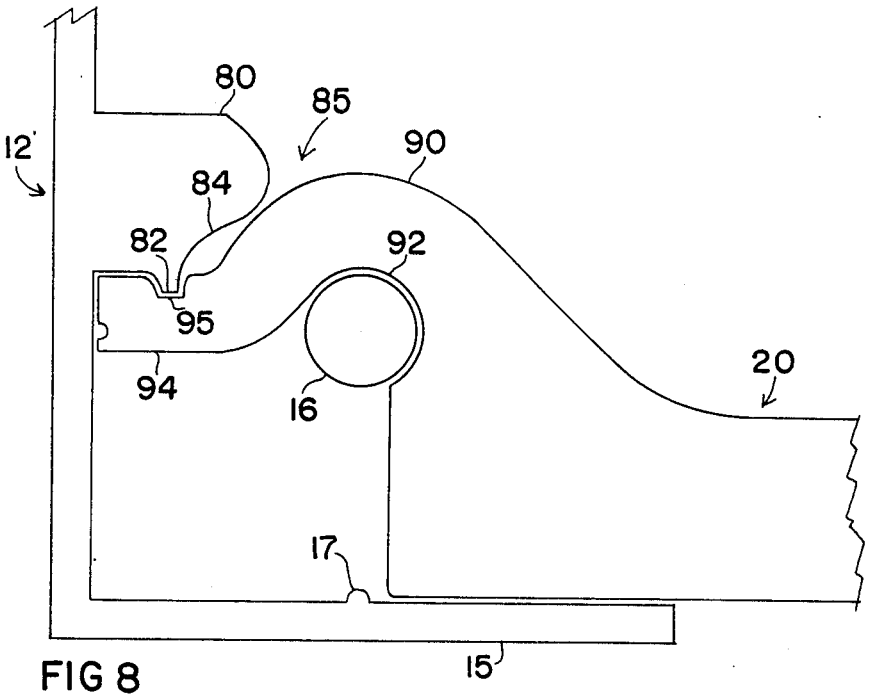
FIG. 8 is diagrammatic fragmentary side view of an alternative hinged coupling arrangement between the housing and base according to the invention with the base in open and substantially horizontal position.

The elongate base 20 is also formed in the manner heretofore described but each of the boundary panels 42 and 44 is formed with a more pronounced curved arm 90 rising above the child support surface 40 with a curved bearing surface 92 formed on the undersurface of curved arm 90 for engaging the cylindrical hinge projection 16 on either side of the housing 12. The curved arm 90 at the hinge coupling end of the elongate base 20 terminates in the base stop edge 94 which is in turn formed on its upper surface with a groove 95 for complementary abutment against and interlocking engagement with the snout or edge 82 of the housing 12 when the base 20 is in the open horizontal position as illustrated in FIG. 8. The complementary interfitting or interlocking abument and engagement of the housing stop edge 80 and base stop edge 94 assures secure retention of the base 20 in its horizontal position despite movement of an infant on the child support surface 40.

Figure 9:
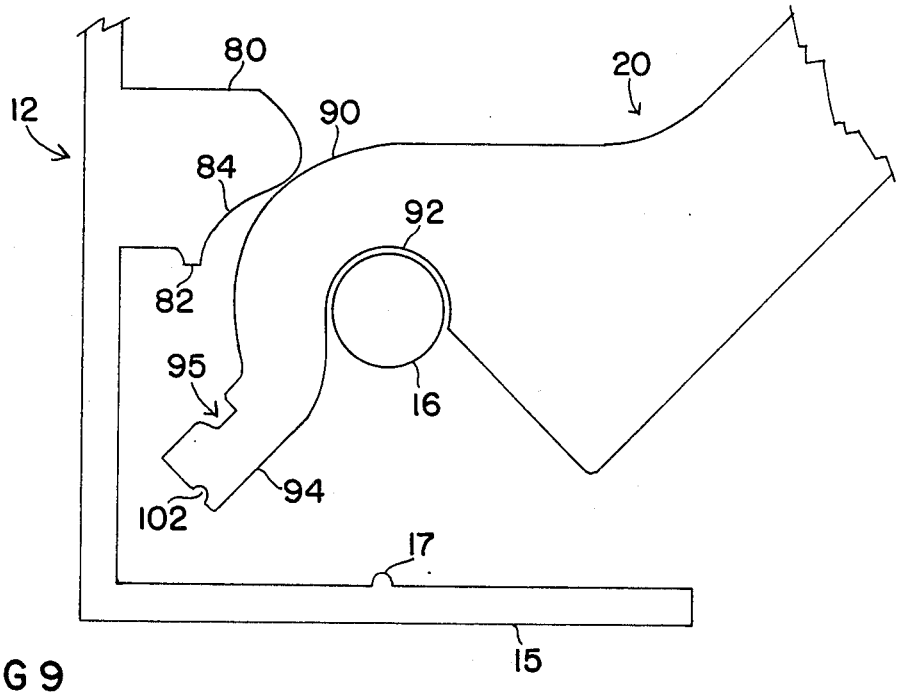
FIG. 9 is fragmentary diagrammatic side view of the hinged coupling arrangement showing the base intermediate between the open and closed position with pivotal motion of the hinge coupling.

The guide channel 85 and surface features and dimensions of the housing stop edge 80, base stop edge 94, base curved arm 90, and housing cylindrical hinge projection 16 are selected for smooth rotational pivotal motion of the base 20 relative to the housing 12 during folding between the open and closed positions as shown in FIG. 9 where the base 20 is in approximately a 45° orientation halfway between the open and closed positions.

Figure 10:
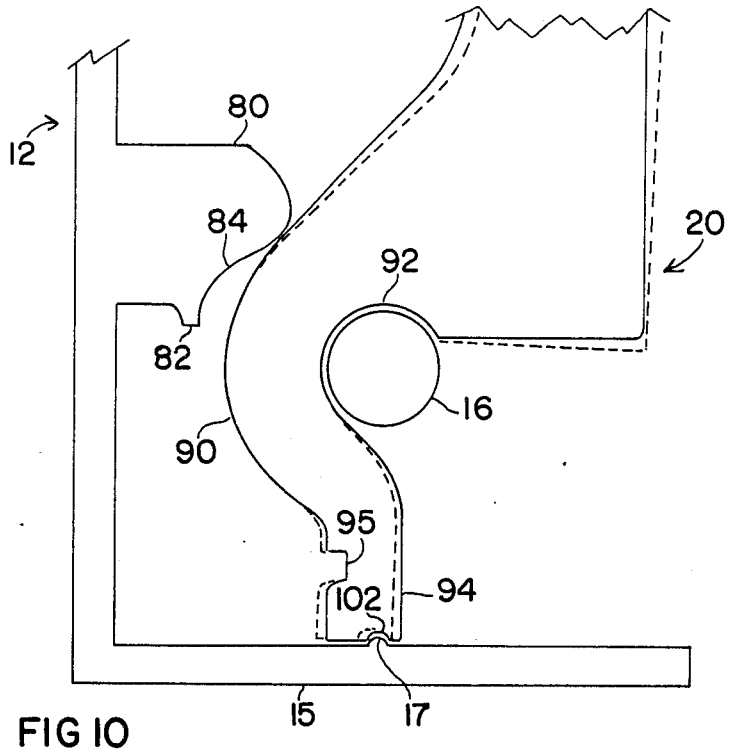
FIG. 10 is a fragmentary diagrammatic side view of the hinged coupling with the base in closed position relative to the housing and showing engagement of the complementary retaining notch and groove as the base approaches the closed position.

As the base 20 approaches the closed vertical position relative to housing 12, as illustrated in FIG. 10, the retaining groove 102 formed in the end of arm 90 and base stop edge 94 approaches the retaining rib or ridge 17 formed on the bottom side or wall 15 of the housing 12 as shown in dotted outline and then engages the retaining ridge 17 as shown by the solid line. The child support base 20 is thereby lodged and retained in the housing 12 until actively unfolded using the handle 18 formed in the base 20.

Figure 11:
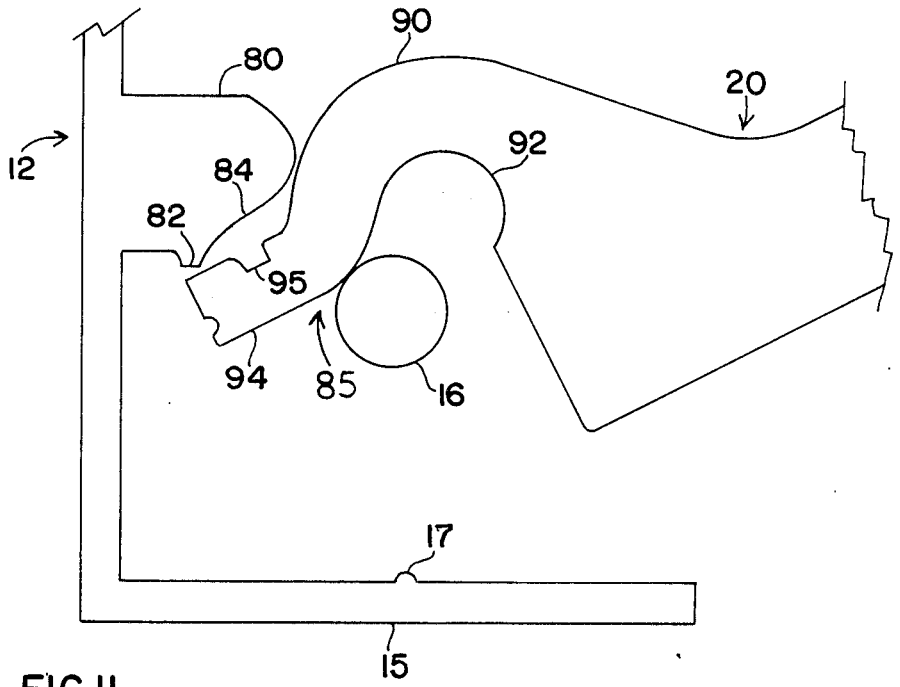
FIG. 11 is a fragmentary diagrammatic side view of the hinged coupling showing the position of the base during disengagement of the base from the housing.
Figure 12A:
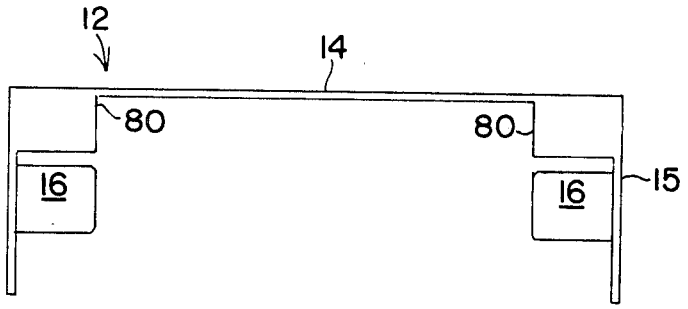
Figure 12B:
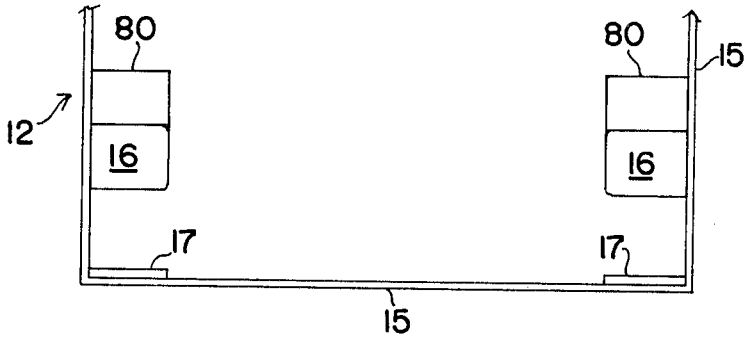
FIG. 12B is a fragmentary front view of the bottom portion of the housing showing the hinge projections and housing stop edge with the retaining ridge visible at the bottom of the housing.

Removal of the base 20 from the housing 12 is illustrated in FIG. 11 where the base 20 is raised at a moderate angle relative to the housing 12 of, for example, approximately 30°. The guide channel 85 defined between the cylindrical hinge projection 16 and guide surface 84 of the housing stop edge 80 provides sufficient leeway for dislodging the complementary edge 82 and groove 95 of the housing stop edge 80 and base stop edge 94 and for smoothly withdrawing the curved arm 90 and bearing surface 92 through the guide channel 85 and away from the hinge coupling 16. The base 20 is replaced in the housing 12 in the pivotally coupling engagement by insertion of the curved arms 90 through the guide channels 85 with the base or bed 20 at substantially the same angle.

Referring to FIG. 12B, it is apparent that in this example embodiment the retaining rib or ridge 17 does not extend entirely across the bottom side 15 of the housing 12 but is formed by two segments on either side of the housing 12 in the same manner that the housing stop edge 80 is formed by two parts spaced on either side of the housing 12.

The invention retaining all of its elements may be embodied in a number of configurations without departing from the scope and spirit of the invention. While the invention has been described with reference to particular example embodiments, it is intended to cover all variations and equivalents within the scope of the following claims.

We claim:

1. A folding child support comprising:

an elongate housing comprising a back and side portions constructed and arranged for mounting on a wall or other vertical surface;

an elongate base comprising a child support surface constructed and arranged for complementary engagement with the elongated housing in a closed position;

pivotal complementary hinge coupling means formed at respective ends of the elongate housing and elongate base, said complementary hinge coupling means removeably and pivotally coupling the base and housing at said respective end for pivotal folding of the base relative to the housing between the closed position and a substantially horizontal weight bearing open position, said complementary hinge coupling means comprising curved bearing surface projections from the side portions of the housing at the hinge coupling means end and curved bearing surface receivers formed in the undersurface of the base on each side at the hinge coupling means end, said curved bearing surface receivers being open on the side and bottom for receiving the curved bearing surface projections for smooth rotational pivotal motion of the base relative to the housing during folding between the closed and open positions;

said housing and base comprising complementary supporting and holding means for self-supporting holding of the base in the substantially horizontal open position and for bearing weight on the child support surface;

said supporting and holding means comprising a first bracing surface formed as an integral part of the housing at the hinge coupling means end of the housing, said base comprising a second bracing surface formed as an integral part of the base at the hinge coupling means end of the base, said first and second bracing surfaces being constructed and arranged for complementary interlocking bracing engagement at the hinge coupling means end of the housing and base for weight bearing self-support of the base from the hinge coupling means end in the substantially horizontal open position;

said complementary hinge coupling means and complementary bracing surfaces being constructed and arranged to cooperate for removeable and replaceable coupling and engagement of the base to the housing and for weight bearing support of the base in the open horizontal position from the cooperating hinge coupling means and bracing surfaces without the requirement of additional or external supports of the base.

2. The folding child support of claim 1 wherein the supporting and holding means comprise a first bracing surface formed as an integral part of the housing, said base comprising a second bracing surface formed as an integral part of the base, said first and second bracing surfaces constructed and arranged for interlocking bracing engagement and support of the base in the substantially horizontal open position.

3. A folding child support comprising:

an elongate housing comprising a back and top end, bottom end and side portions constructed and arranged for mounting on a wall or other vertical surface, said housing comprising hinge pojection means projecting from the side portions near the bottom end of the housing;

and an elongate base comprising a child support surface with safety boundary portions constructed and arranged for complementary engagement in the elongate housing in a closed position, said base comprising complementary hinge projection receiving means at one end thereof for removable and replaceable interfitting hinged coupling with the hinge projection means at the bottom of the housing and for pivotal folding of the base relative to the housing between the closed position and a substantially weight bearing horizontal open position;

said hinge projection means comprising curved bearing surface projections from the side portions of the housing and said hinge projection receiving means comprising curved bearing surface recesses formed in the undersurface of the base on each side at the end of the base, said hinge projection receiving means being open on one side and bottom for receiving the hinge projection means for smooth rotational pivotal motion of the base relative to the housing during folding between the closed and open positions;

said housing comprising first stop edge means formed on said housing at the hinge projection means end of the housing, said base comprising second stop edge means constructed and arranged at the hinge projection receiving means end of the base for abutting against the first stop edge means said complementary hinge projection means and hinge projection receiving means and first and second stop edge means being constructed and arranged to cooperate for securing and maintaining the base from the hinge projection receiving means end without additional or external supports and for weight bearing on the child support surface in the substantially horizontal open position;

said housing and base comprising retaining means for retaining the base in the housing in the closed position.

4. The folding child support of claim 3 wherein the first stop edge means comprises a housing stop edge formed substantially across the width of the housing at the back of the housing at the hinge projection means end of the housing and wherein the second stop edge means comprises a base stop edge formed across at least a portion of the width of the base along the hinge projection receiving means end of the base for abutment of the base stop edge against the housing stop edge when the base is in the open position with the child support surface substantially horizontal.

5. The folding child support of claim 4 wherein the base stop edge and the housing stop edge are formed with complementary interlocking surfaces for interlocking abutment of the base stop edge and housing stop edge when the base is in the open position thereby securing the child support surface in a safe horizontal position.

6. The folding child support unit of claim 3 wherein the base is formed at its hinge projection receiving means end with safety boundary portions along the sides of the base which terminate in curved arms with the curved bearing surfaces formed on the lower side of the curved arms and constructed and arranged for curving over the cylindrical projections at the side portions of the housing, said curved arms extending beyond the end of the base and terminating in the base stop edge, and wherein the housing stop edge is formed with extending guide surfaces spaced from the cylindrical projections at the side portions of the housing for defining guide channels with an opening between the cylindrical projections and guide surfaces for receiving the curved arms at the ends of the boundary portions of the base and for maintaining the complementary curved bearing surfaces on the lower side of the curved arms in close proximity contact with the cylindrical projections during folding motion of the base between the closed and open positions, said extended guide surfaces being spaced from the cylindrical projections a sufficient distance to permit retraction of the curved arms through the guide channels for removing and replacing the base with respect to the housing.

7. The folding child support of claim 6 wherein the retaining means for retaining the housing and base in closed position comprises complementary rib means and notch means formed in the hinge projection means end of the housing and in the hinge projection receiving means end of the base, said rib means and notch means constructed and arranged for complementary engagement of the notch means over the rib means when the base is pivotally folded into the closed position.

8. The folding child support of claim 7 wherein the notch means comprises base notches formed on each side of the base in the safety boundary portions only on each side of the base, and wherein the rib means comprises housing ribs formed at each side of the housing in the bottom end in positions complementary with the base notches.

9. The folding child support of claim 8 wherein the rib means comprises a housing rib formed across the bottom side of the housing and wherein the notch means comprises a base notch formed across the hinge projection receiving means end of the base.

10. The folding child support of claim 3 wherein the elongate base comprises a molded plastic unit with a recessed child support surface and boundary panels formed on each side of the base rising above the child support surface, said boundary panels formed with at least one molded "U" shaped depression having the legs of the U-shaped depression extending to the outside of the boundary panel, said U shaped depression being in a horizontal orientation and open at the top when the base is in the open horizontal position, thereby providing an effective hook for hanging objects from the base, said boundary panels also formed with at least one molded well for receiving and retaining an object such as a bottle or can in the base when the base is in the open position, said molded well formed with at least one drain hole through the base at the bottom of the well.

11. The folding child support of claim 10 wherein the boundary panel on one side of the base is formed with a first indentation with holes for fixedly securing a safety strap to the boundary panel on one side and wherein the other boundary panel is formed with a second indentation, and further comprising strap means secured to the first indentation of the boundary panel on one side and wherein the strap and second indentation are formed with complementary disconnect coupling means for removably and replaceably securing the other end of the strap to the second indentation for providing a safety retaining strap for holding and restraining a child in a horizontal position lying on the child support surface.

12. The folding child strap support of claim 11 wherein the first boundary panel is formed with a strip having the first indentation above and a passageway below for wrapping a strap underneath and over the strip.

13. The folding child support of claim 10 wherein the base is formed with a child support surface having at least one integrally molded dish depression for holding pins or other objects, and at least one drain hole formed through the base in the molded dish depression.

14. The folding child support of claim 10 wherein the housing comprises an integrally molded unit comprising at least one flat shelf for supporting diapers and similar objects and further comprising a curved shelf for retaining a towl roll, said shelf formed with sufficient curvature to grasp and retain a towel roll during unrolling of towel segments from a towel roll onto the child support surface of the base when the base is in open position.

15. The folding child support of claim 14 wherein the curved shelf is formed with a slot below the outer edge of the curved shelf for passing and guiding the end of a towel roll through the slot for dispensing towel segments from the roll.

16. The folding child support of claim 15 wherein the curved shelf is formed with integrally molded extending slot edges bounding the slot for guiding the end of a towel roll and providing a towel cutting edge, said projecting edges formed with finger cutouts for grasping the end of a towel roll passing through the slot.

17. The folding child support of claim 14 wherein the curved shelf is formed with complementary steps on either side with steps of similar height at variable spaced on either side for accommodating towel rolls of different width and for centering the towel roll in the curved shelf.

18. The folding child support of claim 6 wherein the curved arms at the ends of the boundary portions on the hinge coupling end of the base are constructed and arranged to rise above the base and boundary portions for extending over the cylidrical projections on the side of the housing, and wherein the child support surface is constructed and arranged to curve upward at the hinged coupling end of the base to meet the curved arms of the boundary portions at the end of the base, said curved arms and child support surface terminating in the second stop edge means.

19. A folding child support comprising:

an elongate housing comprising a back and top and bottom ends and side portions constructed and arranged for mounting on a wall or other vertical surface, said housing comprising hinge projection means projecting from the side portions near the bottom end of the housing, said elongate housing comprising an integrally molded unit formed with at least one flat shelf for holding diapers or other objects, and at least one curved shelf for holding a towel roll and for dispensing towel roll sections;

an elongate base comprising a child support surface with safety boundary portions constructed and arranged for complementary closing engagement into the elongate housing in a closed position, said base comprising complementary hinge projecton receiving means at one end thereof in the form of curved arms at the end of the boundary portions defining curved bearing surfaces for removable and replaceable interfitting hinged coupling with the hinged projection means at the side portions near the bottom end of the housing and for pivotal folding of the base relative to the housing between the closed position and a substantially horizontal open position, said elongate base comprising an integrally molded unit having a recessed child support surface with boundary panels along each side rising above the support surface, said boundary panels formed with at least one molded well for receiving and holding an object such as a bottle or can when the base is in open position, said boundary panels formed with at least one channel depression providing hook means for hanging an object from the base;

said housing formed with first stop edge means at the hinge projection means end of the housing as an integral part of the housing and said base formed with second stop edge means constructed and arranged at the hinge projection receiving means end of the base as an integral part of the base for abutting against the first stop edge means when the child support surface is substantially horizontal with the base in open position, said first stop edge means and second stop edge means formed with complementary interfitting abutting surfaces for securing and maintaining the base from the hinge projection receiving means end for weight bearing support and in fixed position relative to the housing so the base cannot separate from the housing in the open position;

said housing and base formed with complementary retaining means for retaining the base in the housing when the base is in closed position.

20. The folding child support of claim 19 wherein the curved arms with curved bearing surfaces for receiving the hinge projection means are formed at the ends of the boundary panels, rising above the boundary panels at the hinged coupling end of the base and wherein the base is constructed and arranged with the child support surface curving upward at the hinge coupling end of the base to meet the curved arms, said curved arms and child support surface terminating at the second stop edge means.

21. The folding child support of claim 19 wherein the complementary abutting surfaces of the first stop edge means and second stop edge means comprise a recess or notch formed in one complementary surface and a complementary projection or ridge formed in the other complementary surface.

22. The folding child support of claim 19 wherein the complementary retaining means for retaining the housing and base in closed position comprise rib means formed across at least a portion of the bottom end of the housing and notch means formed across at least a portion of the hinge projection receiving means end of the base, said notch means and rib means constructed and arranged for interfitting engagement when the base is in closed position.

23. The folding child support of claim 19 wherein the first stop edge comprises an extended guide surface spaced from the hinge projection means for defining guide channels between the hinge projection means and guide surface opening on the side for receiving the curved arms at the end of the base and for constraining the curved arms and curved bearing surfaces in contact with the hinge projection means for smooth pivotal motion of the base relative to the housing during folding of the base between the open and closed positions, said curved arms being retractable and replaceable through the guide channels defined between the hinge projection means and guide surface when the base is at a position intermediate between the closed and open positions.

24. The folding child support of claim 19 wherein the base is formed with boundary panels on either side formed with depressions fixedly securing a safety strap on one side and removably securing the safety strap on the other side for holding a child placed on the child support surface.

25. The folding child support of claim 19 wherein the molded well formed in the boundary panel is formed with at least one drain hole through the base at the bottom of the well.

26. An improved hinge coupling for pivotal folding of a framework having side portions and a base comprising:

said framework comprising hinge projection means projecting from the side portions near one end of the framework;

said base comprising complementary hinge projection receiving means at one end thereof for interfitting hinged coupling with the hinge projection means at one end of the framework for pivotal folding of the base relative to the framework between a substantially vertical position and a substantially horizontal position;

said hinge projection means comprising curved bearing surface projections from the side portions of the framework and said hinge projection receiving means comprising curved bearing surface recesses formed in the undersurface of the base on each side at the hinge projection receiving means end of the base said curved bearing surface recesses being open on the side and bottom for receiving the hinge projection means for smooth rotational pivotal motion of the base relative to the framework during folding between the substantially vertical and horizontal positions;

said framework comprising first stop edge means formed on the framework at the hinge projection means end;

said base comprising second stop edge means constructed and arranged at the hinge projection receiving means end of the base for abutting against the first stop edge means said first and second stop edge means constructed and arranged for complementary bracing engagement, said hinge projection means, hinge projection receiving means and first and second stop edge means being constructed and arranged to cooperate for removable and releasable hinged coupling of the base to the framework and for securing and maintaining the base from the hinge projection receiving means end for weight bearing support in the substantially horizontal position.

27. The improved hinge coupling of claim 26 wherein the first stop edge and the second stop edge are formed with complementary interlocking surfaces for interlocking abutment of the first stop edge and housing stop edge when the base is in the substantially horizontal position.

28. The improved hinge coupling of claim 26 wherein the base is formed at its hinged coupling end with extending curved arms, said curved bearing surfaces formed on the lower side of the curved arms and constructed and arranged for curving over the cylindrical projections at the side portions of the framework, said curved arms terminating in the second stop edge and wherein the first stop edge is formed with extending guide surfaces spaced from the cylindrical projections at the side portions of the housing for defining guide channels between the cylindrical projections and guide surfaces opening on the side for receiving the curved arms at the ends of the boundary portions of the base and for maintaining the complementary curved bearing surfaces on the lower side of the curved arms in close proximity contact with the cylindrical projections during folding motion of the base between the substantially vertical and horizontal positions said extending guide surface being spaced from the cylindrical projections a sufficient distance to permit retraction of the curved arms through the guide channels for removing and replacing the base with respect to the framework.

29. The improved hinge coupling of claim 26 wherein complementary rib means and notch means are formed in the bottom of the framework and in the hinge projection receiving means end of the base, said rib means and notch means constructed and arranged for complementary engagement of the notch means over the rib means when the base is pivotally folded to the closed position for retaining the framework and base in closed position.

* * * * *